US007543382B2

(12) United States Patent
Dick et al.

(10) Patent No.: US 7,543,382 B2
(45) Date of Patent: Jun. 9, 2009

(54) METHOD FOR DETERMINING THE POSITION OF A COMPONENT IN A STEPPED BORE OF A HOUSING, AND AN INJECTOR FOR FUEL INJECTION

(75) Inventors: Jürgen Dick, Laaber (DE); Willibald Schürz, Pielenhofen (DE); Martin Simmet, Bad Abbach (DE)

(73) Assignee: Continental Automotive GmbH, Munich (DE)

( * ) Notice: Subject to any disclaimer, the term of this patent is extended or adjusted under 35 U.S.C. 154(b) by 352 days.

(21) Appl. No.: 10/534,681

(22) PCT Filed: Jan. 30, 2004

(86) PCT No.: PCT/EP2004/000906

§ 371 (c)(1),
(2), (4) Date: May 12, 2005

(87) PCT Pub. No.: WO2004/070196

PCT Pub. Date: Aug. 19, 2004

(65) Prior Publication Data

US 2006/0005388 A1 Jan. 12, 2006

(30) Foreign Application Priority Data

Feb. 4, 2003 (DE) ..... 103 04 458

(51) Int. Cl.
*B21D 51/16* (2006.01)
*B21K 1/20* (2006.01)

(52) U.S. Cl. ..... 29/890.124; 29/890.127

(58) Field of Classification Search ..... 239/88–91, 239/102.2, 533.2, 533.9, 533.11, 585.1, 585.3, 239/585.5; 29/890.124, 890.127; 251/129.15, 251/129.21, 127
See application file for complete search history.

(56) References Cited

U.S. PATENT DOCUMENTS 4,909,440 A * 3/1990 Mitsuyasu et al. ..... 239/96

(Continued)

FOREIGN PATENT DOCUMENTS

DE 199 02 807 C1 6/2000

(Continued)

*Primary Examiner*—Davis Hwu
(74) *Attorney, Agent, or Firm*—Laurence A. Greenberg; Werner H. Stemer; Ralph E. Locher

(57) ABSTRACT

The invention relates to a method and an injector for determining a position of a second part (10) inside a stepped boring (6). This part should assume an exact distance (H) from a first part (2). In order to determine the distance (H) between both parts (2, 10), a collar (3) is firstly introduced into a second boring (6*b*) of the stepped boring (6) until it rests upon a step (16) of the stepped boring (6). Afterwards, a punch (4), together with a touch probe (5), which is located inside a longitudinal boring (d), is placed upon a lower annular surface (17) of the collar (3) or on an underside (17*a*) of the first part (2), and the collar (3) is compressed until the predetermined distance (H) is obtained. The distance (H) is measured to a reference measure (x) between a projecting end piece (E) of the touch probe (5) and a reference mark (B) outside of the punch (4). The stamping process is stopped once the reference measure (x) has been obtained.

7 Claims, 2 Drawing Sheets

U.S. PATENT DOCUMENTS

| | | | | |
|---|---|---|---|---|
| 5,775,600 | A | 7/1998 | Wildeson et al. | |
| 6,062,533 | A * | 5/2000 | Kappel et al. | 251/57 |
| 6,425,376 | B1 * | 7/2002 | Ruehle et al. | 123/498 |
| 6,705,587 | B1 | 3/2004 | Frank et al. | |

FOREIGN PATENT DOCUMENTS

| | | |
|---|---|---|
| DE | 199 21 242 C1 | 10/2000 |
| DE | 199 56 256 A1 | 6/2001 |
| WO | 96/41947 | 12/1996 |

* cited by examiner

METHOD FOR DETERMINING THE POSITION OF A COMPONENT IN A STEPPED BORE OF A HOUSING, AND AN INJECTOR FOR FUEL INJECTION

BACKGROUND OF THE INVENTION

Field of the Invention

The invention is based on a method for determining the position of a second component in a stepped bore of a housing, in particular an injector housing, having two bores of two different diameters, the second component in the second bore being intended to be arranged at a predefined distance from a lower side of a first component, which is already fixed in the smaller first bore, and a coining ring being inserted into the larger, second bore up to a step of the stepped bore, which a die compresses until the predefined distance from the first component is achieved and the second component then being inserted up to the compressed die ring, or an injector for fuel injection into an internal combustion engine of a motor vehicle.

Injectors for fuel injection into an internal combustion engine having a piezo-electric actuator as the drive unit in particular have to be manufactured with maximum precision, as on the one hand the change in the length of the actuator produced by a voltage pulse is only of the order μm and is therefore extremely minimal. On the other hand the quantities of fuel to be injected have to be precisely proportioned in order to optimize combustion processes in the engine and to comply with the required emission limits. To be able to satisfy these requirements, the individual mechanical parts of the injector in particular must be manufactured with maximum precision. Even linear measurements with strict manufacturing tolerances can accumulate to produce unpermitted errors.

Until now this problem was resolved by dimensioning the individual components exactly and then introducing precisely manufactured spacer rings into the bore to compensate for the calculated measurement errors when positioning individual components precisely in the injector. This method requires many different spacer rings to be kept in stock. This procedure is therefore very expensive and increases the manufacturing costs of the injector significantly.

A method has also become known from DE 199 56 256 A1, in which a ferrule is introduced into a stepped bore of an injector. The ferrule is placed on the step at the transition between two bores in the stepped bore. The ferrule is then compressed using a stamping tool, until the required distanced from a first component already fixed in the stepped bore is achieved. To be able to control the stamping process, an electric sensor is integrated in an insulated fashion at the tip of the die to supply a disconnect signal to a drive unit of the die, as soon as contact is made with the fixed first component. An unfavorable aspect of this appears to be that the measuring point of the electric sensor at the tip of the die is not visible during the compression process, as it is inside the stepped bore and cannot be observed there. This can result in control errors, if for example a dirt particle is deposited on the sensor head and the sensor disconnects the drive unit too early as a result. As there is practically no possibility of control, this can easily result in an unidentified manufacturing error.

SUMMARY OF THE INVENTION

The object of the invention is to locate the position of the components to be integrated in the housing precisely in a housing, in particular in an injector for fuel injection, at a predefined distance in a stepped bore. The object also comprises providing an improved injector. The object is achieved with the features of the independent claims 1 and 7.

The method according to the invention for determining the position of a second component in a stepped bore and the injector with the characterizing features of the independent claims 1 and 7 in contrast have the advantage that the measuring point is outside the bore and the distance from the component fixed in the bore can be read using a probe, which creates a reference measurement between the projecting end piece of the probe and a reference mark on the die. It is thereby simple to control the measuring process at any time, to improve manufacturing consistency. It is deemed particularly advantageous that the stamping process can be observed continuously so that an approximation to the reference measurement can be observed and verified in a simple fashion.

The measures listed in the dependent claims result in advantageous developments and improvements of the method specified in the independent claims 1 and 7 or the injector. It is deemed particularly advantageous that the reference measurement can be greater by a predefined value than the predefined distance. This advantageously means that after integration the two components are at a certain distance from each other, which can be used as the idle stroke for the actuator.

The reference measurement can be recorded in a particularly simple fashion using a known mechanical or optical measuring device such as a feeler gage, dial gage, eyepiece, camera, interference method, etc. The measuring devices operate reliably and can also be operated easily by untrained personnel.

After automatic series manufacture it appears particularly favorable to record the reference measurement with an electrical measuring device, for example a simple electric contact. It is thereby particularly advantageous that the measuring process can be automated, so that fewer qualified personnel are required and manufacturing costs can be reduced.

A preferred and advantageous application of the method is seen in the case of an injector for fuel injection, as in this instance the distance between the components to be integrated in the stepped bore of the injector housing has to be complied with to a particularly high level of precision.

As its physical characteristics are such that a piezo-electric actuator only changes very slightly in length, compliance with the exact distance from a second component, for example a servo-valve, a nozzle body, a deflection device, etc. is particularly important, in order to be able to utilize the available length change in the actuator as fully as possible.

In the case of the injector for fuel injection it is deemed particularly advantageous that the ring width of the ferrule is greater than the step width of the stepped bore. This results in a better bearing surface for the second component, which can as a result be positioned more securely and more precisely in the stepped bore.

A smooth and in particular polished bearing surface of the ferrule also appears to be advantageous for play-free positioning of the second component. It would be very difficult and involve a high level of extra cost to manufacture such a precise surface directly on the step, as the step is located relatively deep inside the bore and is therefore very difficult to reach with a tool.

BREIF DESCRIPTION OF THE DRAWING

A plurality of exemplary embodiments of the invention are illustrated in the drawing and are described in more detail in the description which follows.

DESCRIPTION OF THE PREFERRED EMBODIMENTS

Figure 1A:
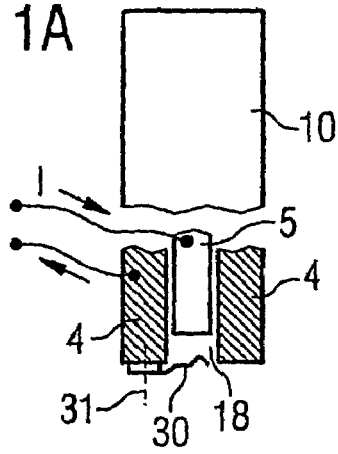
FIG. 1A shows two exemplary embodiments of the invention with an injector.

FIG. 1A shows a schematic illustration of a housing 1, having a stepped bore 6 in the axial direction. The housing 1 can quite generally be a unit, into which two components 2, 10 are to be integrated at a predefined distance from each other exactly and with low tolerances. In the preferred application according to the invention an injector housing is used as the housing 1, into which the two components 2 and 10 are to be integrated. The first component 2 is for example an actuator, in particular a piezo-electric actuator. A second component 10 is to be integrated at a predefined distance H from the first component 2. The first component 2 can however also be a base plate of the actuator, etc.

The second component 10 is configured as a control element, in particular it can be a stroke inverter, a nozzle body or an activation element of a servo-valve, etc., which is to be activated by the piezo-electric actuator 2.

Before the second component 10 can be integrated, the first component 2 is first inserted into a first bore 6*a* of the stepped bore 6 as exactly as possible in a place provided for this purpose and fixed there. A lower side 17*a* of the first component 2 forms a first reference surface for the predefined distance H. The first bore 6*a* can be seen in the upper part of FIG. 1 and has a first diameter d1, which is smaller than a second diameter d2 of a second bore 6*b*. The second bore 6*b* is arranged in the lower part of the stepped bore 6. An annular step 16 is formed at the transition between the two bores 6*a*, 6*b* because of the different diameters d1, d2.

In a next step a ferrule or coining ring 3 is inserted into the second bore 6*b* with the larger diameter d2 until it rests on the annular step 16 of the stepped bore 6. The ferrule 3 is shaped such that it does not impair the function of the second component 10 to be integrated later.

The lower side 17*a* of the first component 2 fixed in the first bore 6*a* therefore forms a reference base in respect of a lower annular surface 17 of the ferrule 3 for a distance H, at which the second component 10 is to be supported in the second bore 6*b* after the ferrule 3 has been stamped.

The height of the ferrule 3 is selected such that by compressing the ferrule 3 the distance H, which is predefined as a target measurement and is measured between the lower side 17*a* of the first component 2 and the lower annular surface 17 of the ferrule 3, can be manufactured to a predefined value.

Once the ferrule 3 has been placed on the step 16, a die 4 is introduced into the second bore 6*b* up to the lower annular surface 17 of the ferrule 3. The die 4 has a central longitudinal bore 18 with a diameter d, into which a probe 5 can be inserted until its head end makes contact with the lower side 17*a* of the first component 2. The length of the probe 5 is a function of the measuring method used and is for example dimensioned such that an end piece E of the probe 5 projects a small way out of the longitudinal bore 18 of the die 4.

In order to be able to produce the required distance H by stamping the ferrule, a first reference mark B is arranged on the die 4, for example in the form of a flat measuring surface. A second reference mark C is also marked on the end piece E of the probe 5 and this too can be configured as a reference surface. A reference measurement x can therefore be measured or read between the first reference mark B on the die 4 and the second reference mark C on the probe 5. The reference measurement x is thereby selected such that, if the reference measurement x exists between the first and second reference marks B, C, the lower annular surface 17 of the ferrule 3 is the distance H from the lower side 17*a* of the first component 2.

In an alternative embodiment of the invention a marking or scale 19 is marked on the end piece E, which can be used to monitor the stamping depth or the distance between the lower side 17*a* of the first component 2 and the lower annular surface 17 of the ferrule 3.

A known stamping device (not shown) is now used to deform the ferrule 3 to the extent that the predefined value x is achieved for the reference measurement and therefore the distance H between the lower annular surface of the ferrule 3 and the lower side 17*a* of the first component 2. For this purpose the ferrule is for example made from an appropriate cold-heading and cold-extruding steel according to DIN 1654.

Alternatively there is also provision for the deformation of the ferrule 3 to be terminated rather sooner. The stamping path is somewhat shorter in this instance. A distance H+dx is therefore set, to which a reference measurement with the value x−dx corresponds. This is advantageous if for example the two components 2, 10 are to be integrated in a contactless manner at a certain distance from each other. This results in an idle stroke with the value dx for the actuator 2.

As the required reference measurement can be observed continuously during the compression process, the compression process can be stopped prematurely when the required distance H+dx is achieved with the assembly measurement x−dx. The described method allows the distance to be set to a precise value so that the individual component tolerances can be compensated for effectively and at low cost.

All mechanical, optical or electrical measuring arrangements known per se can be used as the measuring device 7, with which the reference measurement x or x−dx is recorded. In a preferred embodiment for example an optical measuring device 7 of the LM series from Heidehain GmbH is used, which is suitable for use in particular in automation technology. This measuring device 7 has a laser interferometric probe, with which measuring accuracies in the nanometer range can be achieved. An He—Ne laser is used for measuring, the light of which is supplied to a miniature interferometer at the measuring point. The miniature interferometer records the measuring movement of a measuring sleeve, corresponding to the distance between the two reference marks B and C on the die 4 and the probe 5, and converts this movement to an optical interference signal. The optical measuring signal is then transmitted via an optical waveguide to an optical evaluation and supply unit and output as a measuring result either on a digital display or on the monitor of a computer. The measuring signal is also used to control or disconnect the stamping device with the die 4, when the required distance H or H+dx or the reference measurement x or x−dx has been achieved.

Alternatively an electric contact can be established between the end piece E of the probe 5 and the die 4, said contact being easy to see and adjust from outside. The electric contact is thereby adjusted such that it supplies a disconnect signal to the stamping device when the required reference measurement x or x−dx is achieved. A section of such an electrical measuring arrangement is illustrated schematically in the lower part of FIG. 1A. A contact lug 31 is arranged on the die 4, with its contact oriented towards the longitudinal bore 18. The height of the contact lug can be adjusted and if necessary the idle stroke dx can be set using an adjusting screw 31. The end piece E of the probe 5 in this instance is rather shorter and is insulated from the die 4. When the ferrule 3 is being stamped, the die 4 moves upwards in relation to the probe 5. The reference measurement x−dx is achieved when the contact lug 31 comes into contact with the probe 5. The contact lug 31 thereby closes an electric circuit I across the probe 5 and the die 4. This signal is then used to terminate the stamping process.

Figure 1B:
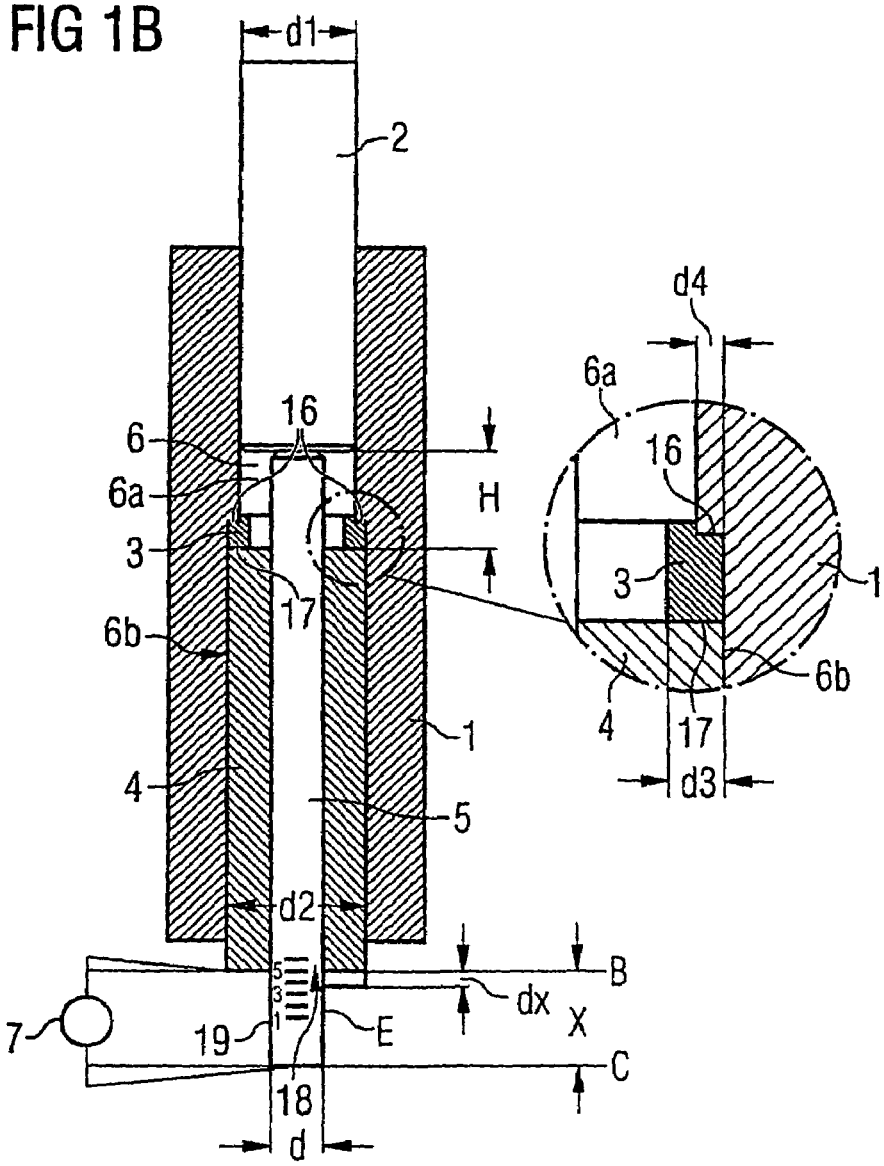
FIG. 1B shows an enlarged section of the injector housing.

FIG. 1B shows an enlarged representation of the stamping process. It shows the ferrule 3, which is shaped by the stamping process to the contour of the step 16 in the wall of the housing 1. Use of the die 4 having a flat and smooth stamping surface, which is also ground precisely at a 90° angle to the longitudinal axis, means that the stamped surface, i.e. the lower annular surface 17 of the ferrule 3, is right-angled and smooth. As a result the introduced second component 10 rests precisely and without play on the ferrule 3, so that a predefined distance H or H+dx or the predefined reference measurement x or x−dx can be complied with exactly.

According to FIG. 1B the ferrule 3 preferably has an annular width d3, which is greater than the width of the step 16, which has a step width d4. The step 16 itself is not so favorable as a bearing surface for the second component 10, as on the one hand its step width d4 is relatively narrow and on the other hand its upper surface has a certain roughness and irregularity due to the machining tools. It may also be disadvantageous that the upper surface can only be machined flat with difficulty due to the long stepped bore 6.

Once the predefined reference measurement x−dx has been achieved, the die 4 and probe 5 are removed from the second bore 6*b* and the second component 10 is inserted until it rests on the lower annular surface 17 of the compressed ferrule 3.

Figure 2:
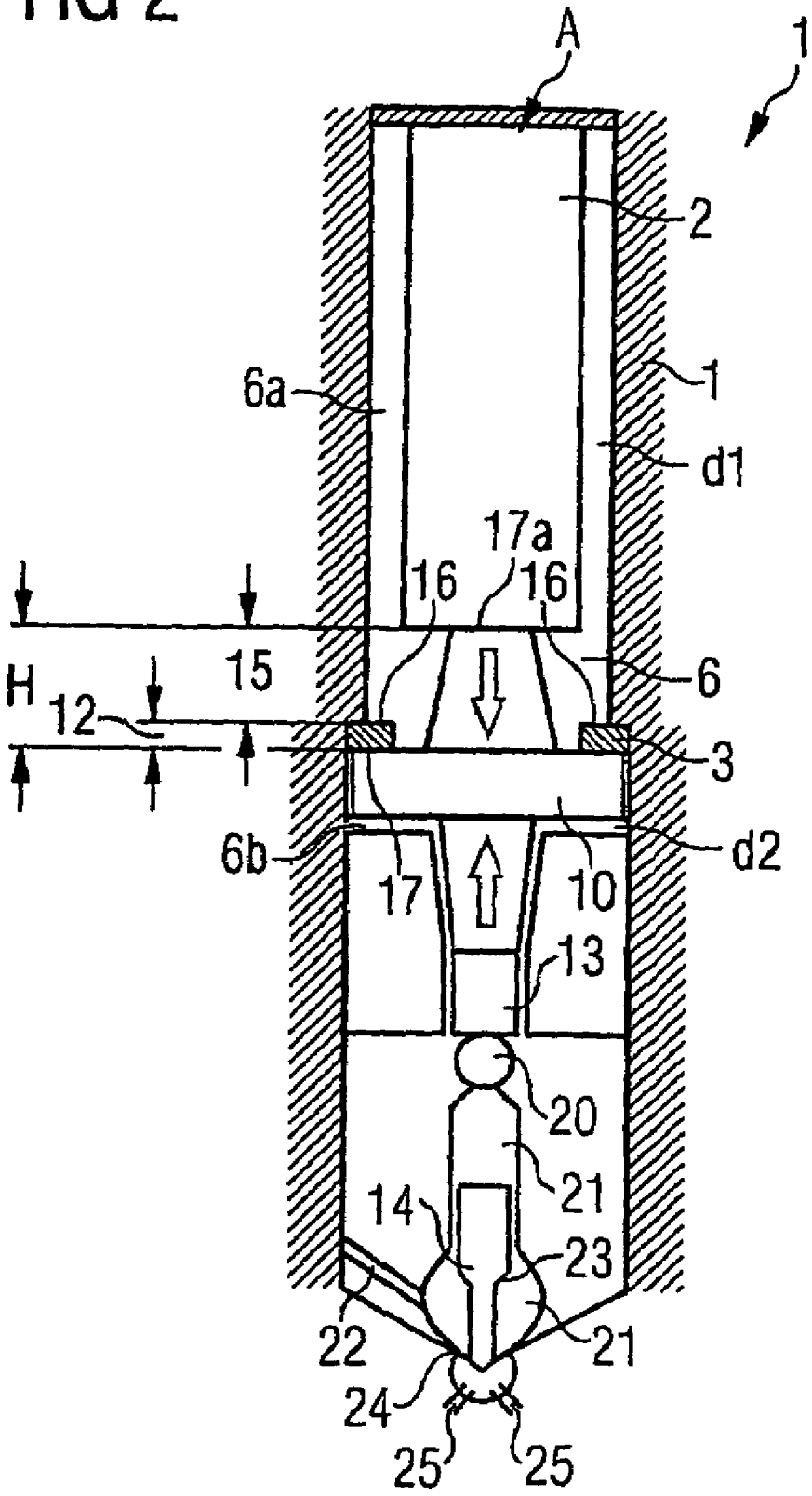
FIG. 2 shows a longitudinal section through an injector.

FIG. 2 shows a schematic illustration of a longitudinal section through an injector for fuel injection for an internal combustion engine of a motor vehicle. First it shows an injector housing 1 with a stepped bore 6. The step 16 results from the two bores 6*a*, 6*b* of the stepped bore 6 with their different diameters. The ferrule 3 is placed on the step 16 and stamped to the required thickness using the setting measurement 12. The first component 2, a piezo-electric actuator, has been inserted into the smaller first bore 6*a* and fixed to the housing 1 at the upper part of the housing 1 at a connection point A. The lower side 17*a* of the piezo-electric actuator 2 has a predefined integration dimension 15 for the first component 2, the actuator, in relation to the lower annular surface 17 of the ferrule 3. Together with the setting measurement 12 of the ferrule, the predefined distance H is obtained from the two measurements 15+12 as the measurement between the lower side 17*a* of the actuator 2 and the lower annular surface 17 of the ferrule 3.

According to one exemplary embodiment of the invention, the second component 10 is configured as a stroke transformer acting as a stroke inverter. The stroke inverter rests without play on the lower annular surface 17 of the ferrule 3 and its lower part moves upward according to the arrows shown, when the actuator 2 extends downward. When the actuator 2 is not activated, the stroke inverter 10 presses via a plunger 13 onto a servo-valve 20, so that said valve closes. The servo-valve 20 regulates the fuel discharge from a control chamber 21, which is supplied with fuel via a supply valve. The control chamber 21 is limited by a nozzle needle 14 that is supported in a movable manner. The fuel pressure pushes the nozzle needle 14 onto a sealed seat 24. In this position the injection holes 25 of the injection valve are closed, being arranged behind the sealed seat of the servo-valve 20 when viewed in the direction of flow. The nozzle needle 14 is arranged in the control chamber 21, which is supplied via a supply line 22.

In the exemplary embodiment shown the stroke inverter 10 rests directly on the lower side 17*a* of the actuator 2. An idle stroke can alternatively also be provided between the actuator 2 and the stroke inverter 10. If the actuator 2 is activated by applying a voltage, the actuator 2 extends and presses onto the stroke inverter 10. The stroke inverter moves the plunger 13 upward so that the closing element of the servo-valve 20 lifts off the sealed seat due to the action of the fuel pressure. This opens the servo-valve 20 so that fuel flows out of the control chamber 21. Fuel flows into the control chamber 21 at the same time via a supply valve but the inflow is less than the outflow. The pressure therefore drops in the control chamber 21. This relieves the load on the nozzle needle 14. Fuel pressure acting on the pressure surfaces of the nozzle needle 14 lifts the nozzle needle 14 off the sealed seat 24. This opens the injection holes 25 and fuel is injected into the combustion chamber of the engine. When the current is discharged from the actuator, the servo-valve 20 closes, the pressure in the control chamber 21 increases and the nozzle needle 14 is pressed onto the sealed seat 24. This ends the injection process.

We claim:

1. A method for positioning a component in a housing, the method comprising:

providing a housing with a first bore having a first diameter and a second bore having second diameter larger than the first diameter, and a step formed between the first bore and the second bore;

fixing a first component with a lower side in the first bore;

inserting a coining ring into the second bore up to the step;

inserting a die with a first reference mark marked thereon and a longitudinal bore formed therein into the second bore;

inserting a probe with a second reference mark into the longitudinal bore until the probe contacts the first component;

establishing a reference measurement between the first and second reference marks representing a distance between the lower annular surface of the coining ring and the lower side of the first component;

compressing the coining ring with the die until the reference measurement corresponds to a predefined value for the distance; and placing the component in the second bore at the distance.

2. The method according to claim 1, wherein the housing is an injector housing.

3. The method according to claim 2, which further comprises monitoring the reference measurement using a mechanical or optical measuring device during compression of the coining ring.

4. The method according to claim 2, which further comprises recording the reference measurement using an electrical measuring device.

5. The method according to claim 2, wherein the component and the first component are inserted into a stepped bore of a housing of a fuel injector.

6. The method according to claim 2, wherein the first component is configured as a piezo-electric actuator.

7. The method according to claim 6, wherein the first component is configured as a base plate of the actuator.

* * * * *